US011260939B2

(12) United States Patent
Popa et al.

(10) Patent No.: US 11,260,939 B2
(45) Date of Patent: Mar. 1, 2022

(54) ADJUSTABLE HEIGHT SPRING-BIASED SUPPORT POLE

(71) Applicant: Quality Mark, Inc., Shafer, MN (US)

(72) Inventors: Nicholas Popa, Forest Lake, MN (US); Mark Ebbenga, Shafer, MN (US); Dana Hallberg, Forest Lake, MN (US)

(73) Assignee: QUALITY MARK, INC., Shafer, MN (US)

( * ) Notice: Subject to any disclaimer, the term of this patent is extended or adjusted under 35 U.S.C. 154(b) by 0 days.

(21) Appl. No.: 16/754,060

(22) PCT Filed: Oct. 1, 2018

(86) PCT No.: PCT/US2018/053689
§ 371 (c)(1),
(2) Date: Apr. 6, 2020

(87) PCT Pub. No.: WO2019/070555
PCT Pub. Date: Apr. 11, 2019

(65) Prior Publication Data

US 2020/0324860 A1 Oct. 15, 2020

Related U.S. Application Data

(60) Provisional application No. 62/568,513, filed on Oct. 5, 2017.

(51) Int. Cl.
*B63B 17/02* (2006.01)
*B63B 17/00* (2006.01)

(52) U.S. Cl.
CPC ..... *B63B 17/02* (2013.01); *B63B 2017/0045* (2013.01)

(58) Field of Classification Search
CPC .. B63B 17/00; B63B 17/02; B63B 2017/0045
(Continued)

(56) References Cited

U.S. PATENT DOCUMENTS 4,379,468 A 4/1983 Szukhent, Jr.
4,484,732 A * 11/1984 Gould ..... F16F 7/00 267/64.14

(Continued)

FOREIGN PATENT DOCUMENTS

DE 20112158 U1 2/2002
SU 517205 A 7/1984

OTHER PUBLICATIONS

International Search Report issued for PCT/US2018/053689, dated Mar. 21, 2019.

(Continued)

*Primary Examiner* — Lars A Olson
(74) *Attorney, Agent, or Firm* — Westman, Champlin & Koehler, P.A.; Z. Peter Sawicki; Amanda M. Prose

(57) ABSTRACT

A spring-biased support pole 10 for supporting a boat cover 40 over a boat during transport of the boat as well as docking of the boat. The support pole comprises a base 14 and a support rod system 100 connected to the base. The support rod system comprises at least two support rod sections 110, 120 that are telescopically connected to one another and a spring 20. The spring is positioned between the telescoping connection of a first support rod section and a second support rod section, such that the spring controls vertical movement of the second support rod section with respect to the first support rod section and provides a biasing force that is applied to the second support rod section and to the cover supported by the support pole.

16 Claims, 2 Drawing Sheets

(58) Field of Classification Search
USPC ..... 114/361
See application file for complete search history.

(56) References Cited

U.S. PATENT DOCUMENTS

| | | | | |
|---|---|---|---|---|
| 4,927,109 | A | 5/1990 | Wilson | |
| 5,441,066 | A * | 8/1995 | Harris | B63B 17/02 135/88.01 |
| 5,450,808 | A | 9/1995 | Beagan | |
| 5,490,532 | A | 2/1996 | Mallookis et al. | |
| 6,308,653 | B1 | 10/2001 | Geraci | |
| 6,802,275 | B2 * | 10/2004 | Schmidt | F16C 11/0604 114/361 |
| 7,647,879 | B2 * | 1/2010 | del Valle Bravo | B63B 17/02 114/361 |
| 2008/0202406 | A1 | 8/2008 | del Valle Bravo et al. | |
| 2013/0300273 | A1 | 11/2013 | Elkasevic | |

OTHER PUBLICATIONS

Written Opinion of the International Searching Authority issued for PCT/US2018/053689, dated Mar. 21, 2019.
Extended European Search Report issued for EP patent application serial No. 18865152.5, dated May 31, 2021.

* cited by examiner

ADJUSTABLE HEIGHT SPRING-BIASED SUPPORT POLE

CROSS-REFERENCE TO RELATED APPLICATION

This Application is a Section 371 National Stage Application of International Application No. PCT/US2018/053689, filed Oct. 1, 2018 and published as WO 2019/070555 A1 on Apr. 11, 2019, in English, which claims priority to U.S. provisional patent application Ser. No. 62/568,513, filed Oct. 5, 2017, the contents of which are hereby incorporated by reference in their entireties.

BACKGROUND

The present invention relates generally to support poles for supporting boat covers attached to a boat. More specifically, the invention relates to a spring-biased support pole having a base such that the support pole may be tilted and can be safely used to support the boat cover on the boat while the boat is being transported.

A boat is generally covered when not in use with a flexible material, such as a canvas tarp. Typically the boat cover extends over the top of the boat from bow to stern. When the boat is left at a dock, the cover over the boat reduces the amount of dirt that will accumulate on the boat and further protects the boat and any contents stored in and on the boat from weather, theft or vandalism. When a boat is towed by a motor vehicle, a cover over the top of the boat will improve the wind resistance of the boat and also enables the boat owner to store articles in and on the boat during transport.

Boat covers are generally attached to the boat around the boat via metal snaps or other tie-down mechanisms. When the boat is being towed by a motor vehicle, for example when transporting the boat to and from a body of water, the tarp will move, or flap with respect to the boat. When the boat is towed on a highway at high speeds, the boat cover may violently flap in the wind, causing undo wear and tear to the cover and sometimes damage to the boat.

Mechanisms currently used to tighten covers attached to boats can break and occasionally permit the cover to fly off of the boat when travelling down the road, causing a danger to passing vehicles as well as possible damage to such vehicles, to the boat and to the cover itself.

SUMMARY

An aspect of the present disclosure relates to an adjustable, spring-biased support pole. The support pole has a base the pole includes a support rod system connected to the base. The support rod system has at least two support rod sections that are telescopically connected to one another. A spring is positioned between the telescoping connection of a first support rod section and a second support rod section, such that the spring controls vertical movement of the second support rod section with respect to the first support rod section and biases a force applied to the second support rod section from an element being supported by the support pole.

The support rod system is pivotally connected to the base, allowing the support rod system connected to the base to pivot around a vertical connection to the base when supporting the element. The element being supported by the support pole may be a cover for an opening of a boat and wherein the base of the support pole is configured to engage with a floor of the boat within the opening, for supporting the cover on the boat.

The support pole may be adjustable in height as the support pole may have a third support rod section telescopically connected to the second support rod section and selectively slidable with respect to the second support rod section to adjust the overall height of the support rod system. A bracket is then configured to secure the position of the third support rod section in connection with the second support rod section to lock the support rod system at a selected height.

A pole cap having an outer surface configured to support the element and a base end configured for insertion into an end of the support pole system opposite the connection with the base may also be provided.

In one embodiment, the support rod system has a plurality of rod sections comprised of a metal such as stainless steel, titanium, aluminum, a metal alloy or a combination thereof. The rod sections are tubular and thus are hollow, which allows the sections to connect in a telescoping manner.

In one embodiment, the spring is wrapped in a synthetic material to reduce friction between the spring and an inner surface of one or more support rod sections. The synthetic material is comprised of flash spun high-density polyethylene fibers.

Another aspect of the present disclosure relates to an adjustable spring-biased support pole having a support rod system pivotally secured to a base. The support rod system has a plurality of telescoping support sections and two adjustment mechanisms for separately vertically adjusting an overall height of the support rod system.

The first adjustment mechanism is a spring that is positioned between a first and second telescoping support section and for biasing downward force from an element supported by the support pole and wherein compression or relaxation of the spring adjusts the overall height of the support rod system in reciprocating vertical directions.

The second adjustment mechanism is an adjustment bracket connecting the second and a third telescoping support section and for securing the third telescoping support section in any one of various adjustable positions with respect to the second telescoping support section and wherein the adjustment bracket can prevent or allow vertical movement of the third telescoping support section with respect to the second telescoping support section.

Yet another aspect of the present disclosure relates to a method of supporting a cover for a boat opening. The method includes providing a spring-biased support pole as described in any one of the embodiments or combinations thereof herein and placing the base of the support pole on a floor surface of the opening of the boat. The method includes adjusting the overall height of the support pole by slidably adjusting a position of a first support rod of the plurality of support rod sections with respect to a second support rod section to which the first support rod section is telescopically connected and supporting an underside of the cover attached to the boat opening with an upper end of the support rod, the upper end being opposite the base.

Compressing the spring with the cover in turn vertically displaces the second support rod section with respect to a third support rod section such that the support pole height adjusts with the movement of the cover to maintain a tension of the cover attached to the boat opening. Relaxing of the spring occurs as the cover moves and in turn vertically displaces the second support rod section with respect to the third support rod section in a reciprocating direction, such that the support pole height adjusts with the movement of the cover to maintain support of the cover attached to the boat opening.

DETAILED DESCRIPTION

A support pole is used to support a cover for a boat opening when the boat is being towed. The support pole can also be used to support and tighten the cover when boat is docked. The support pole allows for upwardly supporting the cover from within the opening of the boat (e.g., under the cover) to reduce violent flapping of the cover during transport or due to weather conditions. The pole is a resilient, spring-biased pole that is adjustable so that the tightening of the cover can be easily completed and changed as needed. The support pole is configured to be vertically adjustable for installation and support, and to also vertical adjust during transport to maintain support for the cover. Further, the support pole also has at least some pivotable movement around the connection of the support pole to its base, preventing the pole from breaking due to high winds or high travel speeds. This allows the support pole to adapt for use with various covers and boats and in various travel conditions, while reducing flapping of the cover and protecting the boat and boat opening as the operating components and seats are positioned within this opening. This can also protect passing motorists by preventing ripping of the cover and debris from flying out of the boat opening.

Figure 1:
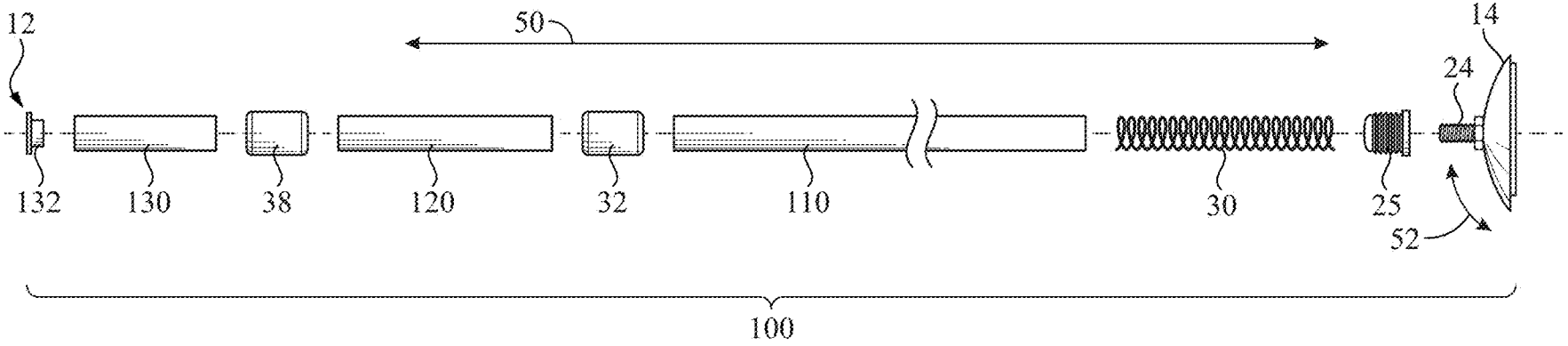
FIG. 1 is an exploded view of the spring-biased support pole.
Figure 2:
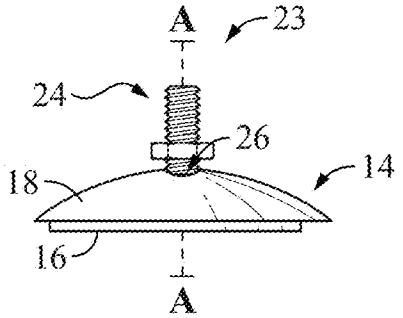
FIG. 2 is a side view of a base and support pole connector of the spring-biased support pole.

A support pole is illustrated generally at 10 in the figures. Referring generally to FIGS. 1 and 2, the support pole 10 comprises a spring-biased support system comprising a first, cover engaging end 12 and a second end that terminates in a base support 14. The cover engaging end 12 and the base support 14 are separated by a support rod system 100. The support rod system 100 comprises at least a bottom support rod section 110 and a second support rod section 120. For example, the second support rod section may be a middle support rod section 120. In such embodiments, a top support rod section 130 may then also be included. Together, the support rod sections allow a user to adjust the overall height of the support rod system 100 for installation within an opening of a boat.

Figure 3:
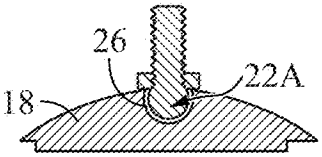
FIG. 3 is a cross-sectional view taken along line A-A, of the base and support pole connector illustrated in FIG. 3.

As illustrated in further detail in FIGS. 2 and 3, the base 14 comprises a ground or floor engaging surface 16 and a top surface 18. The base 14 is constructed of a resilient tough material and may have additional coatings for durability and frictional engagement with a ground or floor surface in the opening of a boat. In one embodiment, the base 14 is comprised of injection molded plastic components that are rubber coated, comprised of a durable yet flexible resilient rubber like material, and/com comprise a material having a textured coating. The base 14 may also be comprised of a hard plastic material.

Within the base 14 is a first end 22 of a connector 24. The connector 24 extends upwardly though an aperture 26 in the top surface 18 of the base 14 and to connect the support rod system 100 to the base 14. The first end 22 of the connector 24 comprises a pivoting mechanism such as a ball 22A. The first end of the connector 24 is then pivotally secured to a reciprocating cavity in the base 14. A second opposing end 23 of the connector 24 is configured to couple a first end 112 of the bottom support rod section 110 to the base 14. The opposing end 23 of the connector 24 is configured to threadably couple to a threaded aperture 27 in the bottom cap 25. The bottom cap 25 is secured to a lower end of the bottom support rod section 110 and inserted therein.

Figure 4:
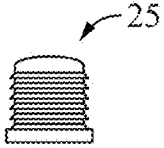
FIG. 4 is a side view of a cap for securing the support pole connector to the support pole.
Figure 5:
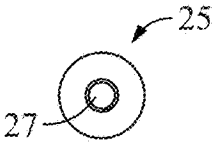
FIG. 5 is a bottom view of the cap.

As illustrated in FIG. 4-5, the bottom cap 25 comprises a ridged length for insertion into the support rod section 110 and for frictional engagement therein. The base 14 can then be threadably secured to the support rod system 100 via connection of the base 14 to the bottom support rod section 110 with cap 25. When connected, the bottom support rod section 110 can pivot or at least partially rotate in reciprocal directions around the vertical axis of the support rod system as represented by arrow 52 in addition to the vertical displacement of the second support rod section 120 along the direction of arrow 50.

The connector 24 vertically secures the support rod system 100 to the base while allowing for the support rod system 100 to pivot about a vertical axis of the connector 24 at the base 14, while preventing vertical movement of the bottom support rod section 110 with respect to the base 14.

Additionally or alternatively, the base may comprise an integrally formed connector extending vertically from the top surface of the base, wherein the base and the connector are constructed of a material that allows the connector limited pivotal movement about the vertical axis along which it extends. That is, the material construction of the base and connector allow the connector itself to tilt or lean when connected to the support rod system thus allowing for at least some angular movement of the support rod system about the base in response to external forces exerted on the cover such as by the wind, for example.

The base 14 may be an integrally molded component with the aperture 26 having a rounded base for allowing pivotal movement of the connector 24 therein. Alternatively, the floor engaging surface 16 and the top surface 18 may be separable components that are secured by the connector 24 extends through an aperture in the floor engaging surface 16 and upwardly through the top surface 18 to connect the floor engaging surface 16 and the top surface 18 of the base 14 to one another. Such fastener may comprise a nut and bolt system.

Referring back to FIG. 1, the bottom support rod section 110 supports a coil spring 30 therein. The bottom support rod section 110 has a first length and the spring 30 has a second length, wherein the length of the relaxed spring is greater than the length of the bottom support rod section 110. This allows the spring 30 to be compressed within the bottom support rod section 110 such that the compressed spring 30 is substantially equal to or greater the length of the support rod section 110. The spring 30 requires a length greater than the length of the bottom support rod section 110 to provide biased vertical support for the second support rod section 120 and to allow the second support rod section 120 to move vertically in reciprocal directions with respect to the bottom support rod section 110 during use of the support rod.

When loading the spring 30 into the bottom support rod section 110 for operable assembly of the support pole 10, a spring washer 31 may be inserted above and/or below the spring 30 to hold the spring 20 in place within a portion of the bottom support pole 110 and above the base 14.

The spring 30 is typically a metal coil spring, although other materials such as plastic are also contemplated, and the length may vary based on the size of the support rod system 100 and the use of the support pole 10. In the embodiment illustrated the spring 20 has approximately a 0.857 inch diameter and approximately an 11.894 length when in a compressed state (e.g., when the coils of the spring touch each other).

The spring 30 may also be wrapped in a material that allows the spring 30 to coil and relax smoothly within the bottom support rod section 110. For example, a nonwoven fabric like synthetic material may be wrapped around the length of the spring 30. In the embodiment illustrated, the material comprises flashspun high-density polyethylene fibers, such material being manufactured by DuPont and sold under the trademark Tyvek®._Although a spring 30 is specifically described other shock absorbing mechanisms such as an air or other gas filled cylinder that provides for vertical movement along the axis of the rod system 14 is contemplated as part of this disclosure. The shock absorbing mechanism needs to have a compression characteristic that once the downward force dissipates the shock absorbing mechanism provides a force to return the rod system to its position against the canvas.

The second support rod section 120 is telescopically connected to the bottom support rod section 110. In the embodiment illustrated, the second support rod section 120 is slidable within the bottom support rod section 120. Thus, both the spring 30 and the second support rod section 120 are moveable within the interior of the bottom support rod section 110. The spring 30 thus vertically supports a first, base, end of the second support rod section 120 and compression and relaxation of the spring 30 allows for vertical movement of the second support rod section 120 with respect to the bottom support rod section 110. The second support rod section 120 is slidably secured to the bottom support rod section 110 via a bracket 32. This bracket 32 prevents the second support rod section 120 from being separated from the bottom support rod section 110. The second support rod 120 is slidable within this bracket 32 such that a length of the bottom support rod section and second support rod section is limited in a first direction by the compression of the spring and limited in a second opposing direction by the bracket 32. This length adjusts "automatically" during use of the support rod system based on the compression or relaxation of the spring due to downward force from the cover support by the system 100. That is, vertical movement of the second support rod section with respect to the bottom support rod section 110 is generally effected during use of the support rod system to maintain vertical support for the cover in a taught position.

The top support rod section 130 is then connectable to the second support rod section 120 at an end opposite the second support rod section 120 connection to the bottom support rod 110. The second support rod section 120 and top support rod section 130 are telescopically connected by a second bracket 38 which is an adjustment bracket 38 that allows the user to selectively adjust the overall length of the support rod system 100 (e.g., height).

An upper length of the second support rod section 120 is configured to slidably receive a lower end of the top support 130 section therewithin. The position of the top support rod 130 section can be selected and locked in position with the bracket 38 which is secured around an upper end of the second support rod section 120 and as the second support rod section 120 has both an outer and an inner diameter greater than the outer diameter of the top support rod section 130, the bracket 38 prevents downward vertical movement of the top support rod section 130 with respect to the middle support rod section 120. Gravity as well as the weight of the cover 40 then prevent significant upward movement of the top support rod section 130.

The adjustment bracket 38 may be a bracket well known in the art and typically a locking cone mechanism often used to secure sections of a telescoping pole. For example, the bracket 38 can be rotated a first directed to frictionally engage and lock the position of the top support rod section 130, thus preventing vertical movement of the top support rod section 130 with respect to the second support rod section 120. The bracket can be rotated a second, opposite directed to unlock the connection and thus allow a user to adjust the position of the top support rod section 130 with respect to the second support rod section 120, allowing a user to selectively adjust the overall height of the support rod system 100, based for example on the weight of the cover 40 material and/or dimensions and the distance between a floor of the boat opening and the cover 40.

Once the top support rod section 130 has been positioned with respect to the middle support rod section 130 such that an operable length of the top support rod section 130 is selected and the overall length of the support rod system 100 selected, the overall length/height of the support pole 10 can be fixed by the adjustment bracket 38 and secured for use. The adjustment bracket 38 can be used as a coarse height selection. The spring 30 and pivotal connection of the support rod system 100 about the base 14 allow for slight height selection changes to ensure a proper fit of the support rod 10 in the boat opening and supporting the cover 40 in a taught position as installed on the boat and over the boat opening.

The top support rod section 130 is configured to receive a pole cap 132. The pole cap 132 is a cap having a generally smooth outer cap surface and a body length configured for insertion into a top end of the support rod section 130. The cap has a body length diameter smaller than the inner diameter of the top support rod 130 and an outer cap surface about equal to or greater than the outer diameter of the top support rod section 130. The pole cap 132 provides a surface that contacts the cover 40 and engages with the underside of the cover 40 so that the support pole 10 can support the cover 40 without damaging the cover 40.

Referring generally to the figures, assembly of the support pole 10 is described in further detail below. The support rod system 100 includes a plurality of telescoping support rod sections 110, 120, 130. In further detail for example, an upper portion of the bottom support rod section 110 is configured to receive a lower end of the middle support rod section 120. The lower end of the middle support rod section 120 is vertically displaceable within the upper portion of the bottom support rod section 110. The vertical displacement of the middle support rod section 120 is supported or prevented by the compression coil spring 30 that is positioned within the main body of the bottom support rod section 110 below the lower end of the middle support rod section 120. The vertical movement of the middle support rod section 120 is controlled by the compression and extension of the coil spring 30, as the lower end of the middle support rod section rests on an end of the extended spring 30. As the spring 30 is compressed, for example, by the cover 40 engaging the top of the support pole 10 and applying a downward force, the lower end of the middle support rod section 120 is pushed down towards the base 14 and is biased upwardly by the coil spring 30. As the cover 40 is displaced upwardly, the spring 20 relaxes and moves the middle support rod section 120 upwardly.

The support rod sections 110, 120, 130 are typically tubular in shape and will be referred to herein as tubes without intending to be limited thereto. The tubes may be extrusions having a circular, rectangular or other geometric cross-sectional dimension. The rod sections 110, 120, 130 may be comprised of a metal, examples including but not limited to, aluminum, titanium, metal alloys, or like materials having durability, strength and a lighter weight feature while also preferably corrosion resistant. The support rod sections 110, 120, 120 may each have a length in the range of about 15 inches to about 50 inches or more, and more specifically in the range of about 20 inches to about 45 inches. Each support rod section 110, 120, 130 may have a different length than one or more of the other support rod sections 110, 120, 130. The lengths of the support rod sections 110, 120, 130 may vary based on use with various size boats, boat openings and/or boat cover dimensions and material.

The support rod sections 110, 120, 130 also have each have an outside diameter and an inside diameter. For example, the outside diameter of the second support rod section 120 is less than the inside diameter of the bottom support rod section 110 so that the second support rod section 120 can be received within a length of the bottom support rod section 110 and slidable therein. If a top support rod section 130 is used, the outer diameter of the top support rod section 130 is thus smaller than the inner diameter of the second support section 120, so that the top support rod section 130 can slide within a length of the second support section 120 for adjusting the overall height of the pole 10.

In the example illustrated in the figures, the bottom support rod section 110 has a length of about 20 inches and a tube diameter (outside diameter) of about 0.9 inches. The second support rod section has a length of about 30 inches and an outside diameter of about 0.866 inches and an inside diameter of about 0.748 inches.

Figure 6:
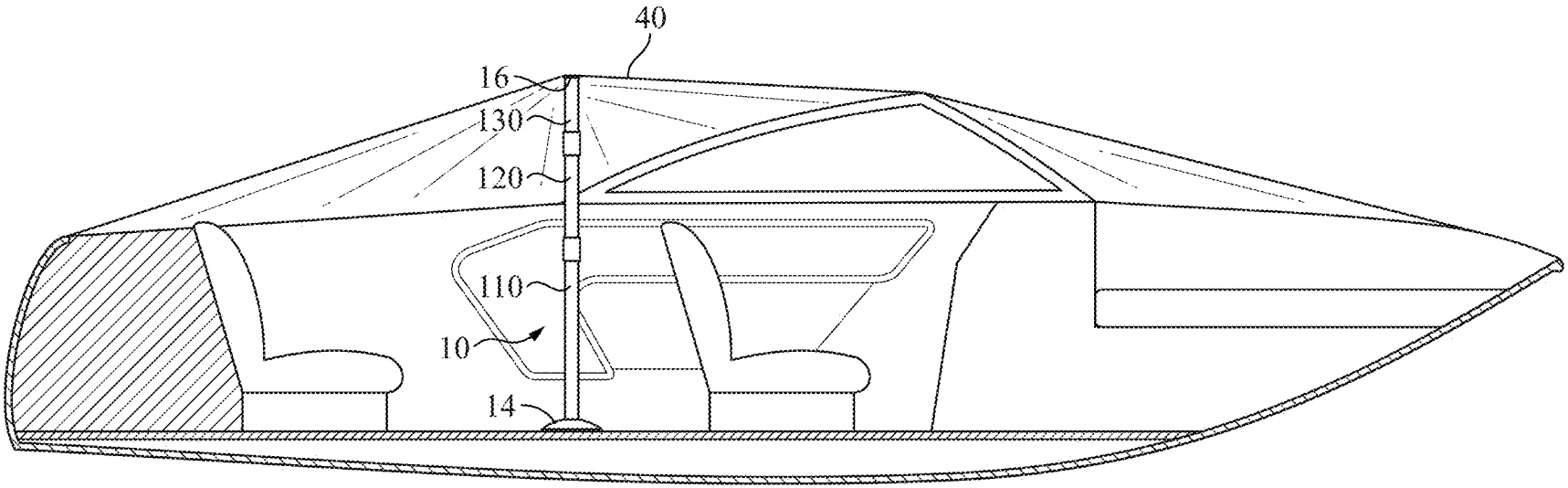
FIG. 6 illustrates the spring-biased support pole supporting a cover.

Generally, as illustrated in FIG. 6, the support pole 10 is positioned such that the base 14 engages with a floor surface of the boat and the upper end 14 is engaged with an underside of the cover 40. The height of the pole 10 is selected based on the distance between the floor of the boat and the cover and the height of the pole 10 may be greater, about equal to, or less than the distance between the floor of the boat and the cover so as to increase or decrease the tension across the surface of the cover 40 depending on whether the boat is docked or ready for towing behind a vehicle.

Although the present disclosure has been described with reference to preferred embodiments, workers skilled in the art will recognize that changes may be made in form and detail without departing from the spirit and scope of the disclosure.

The invention claimed is:

1. A spring-biased support pole comprising:

a base having a substantially flat bottom surface and an aperture in a top surface wherein an attachment mechanism comprising a threaded length is pivotally coupled to the base at a first end thereof within the aperture in the base, and wherein a second end of the threaded length extends upwardly from the base;

a support rod system pivotally connected to the base, and the support rod system comprising at least two support rod sections that are telescopically connected to one another;

a cap configured to couple to the second end of the threaded length pivotally connected to the base, and wherein the cap couples to the support rod system to secure the support rod system to the attachment mechanism; and a spring, wherein the spring is positioned between the telescoping connection of a first support rod section and a second support rod section, such that the spring controls vertical movement of the second support rod section with respect to the first support rod section and biases a force applied to the second support rod section from an element being supported by the support pole and where the connection between the support rod system and the base allows the support rod system connected to the base to pivot around a vertical connection to the base when supporting the element.

2. The support pole of claim 1, where in the element being supported by the support pole is a cover for an opening of a boat and wherein the base of the support pole is configured to engage with a floor of the boat within the opening, for supporting the cover on the boat.

3. The support pole of claim 1, and the support pole being adjustable in height as the support pole further comprises a third support rod section telescopically connected to the second support rod section and selectively slidable with respect to the second support rod section to adjust the overall height of the support rod system.

4. The support pole of claim 3, and further comprising a bracket configured to secure the position of the third support rod section in connection with the second support rod section to lock the support rod system at a selected height.

5. The support pole of claim 1, and further comprising a pole cap having an outer surface configured to support the element and a base end configured for insertion into an end of the support pole system opposite the connection with the base.

6. The support pole of claim 1, wherein the base is comprised of a plastic material.

7. The support pole of claim 1, wherein the support rod system comprises a plurality of rod sections comprised of stainless steel, titanium, aluminum, a metal alloy or a combination thereof.

8. The support pole of claim 1, wherein the spring is wrapped in a synthetic material to reduce friction between the spring and an inner surface of one or more support rod sections.

9. The support pole of claim 8, wherein the synthetic material is comprised of flash spun high-density polyethylene fibers.

10. An adjustable spring-biased support pole comprising:

a support rod system pivotally secured to a base with a cap that couples to the support rod and to the base and wherein the cap has a first end that is received within an end of the support rod system and a second end that receives an attachment mechanism that is pivotally secured to the base, and wherein the support rod system comprises a plurality of telescoping support sections and two adjustment mechanisms for separately vertically adjusting an overall height of the support rod system.

11. The pole of claim 10, wherein a first adjustment mechanism comprises a spring and is positioned between a first and second telescoping support section and for biasing downward force from an element supported by the support pole and wherein compression or relaxation of the spring adjusts the overall height of the support rod system in reciprocating vertical directions.

12. The pole of claim 11, wherein a second adjustment mechanism comprises an adjustment bracket connecting the second and a third telescoping support section and for securing the third telescoping support section in any one of various adjustable positions with respect to the second telescoping support section and wherein the adjustment bracket can prevent or allow vertical movement of the third telescoping support section with respect to the second telescoping support section.

13. A method of supporting a cover for a boat opening comprising:

providing a spring-biased support pole comprising a base and an adjustable height support rod system comprising a plurality of support rod sections, where the support rod system is pivotally connected to the base and the spring is retained by the support rod system between the connection of two adjacent support rod sections for biasing force absorbed by the system from the cover for the boat opening;

removably placing the base of the support pole on a floor surface of the opening of the boat;

coupling a cap to a lower end of the support rod system and coupling the cap to a threaded length extending outwardly from a pivotal connection with the base;

adjusting the overall height of the support pole by slidably adjusting a position of a first support rod of the plurality of support rod sections with respect to a second support rod section to which the first support rod section is telescopically connected; and supporting an underside of the cover attached to the boat opening with an upper end of the support rod, the upper end being opposite the base.

14. The method of claim 13, wherein the support rod system is vertically connected to the base and configured to pivot around its connection to the base when supporting the cover attached to the boat opening.

15. The method of claim 13, and compressing the spring with the cover to in turn vertically displace the second support rod section with respect to a third support rod section such that the support pole height adjusts with the movement of the cover to maintain a tension of the cover attached to the boat opening.

16. The method of claim 14, wherein relaxing of the spring occurs as the cover moves and in turn vertically displaces the second support rod section with respect to the third support rod section in a reciprocating direction, such that the support pole height adjusts with the movement of the cover to maintain support of the cover attached to the boat opening.

* * * * *